US007552768B2

(12) United States Patent
O'Brien

(10) Patent No.: US 7,552,768 B2
(45) Date of Patent: Jun. 30, 2009

(54) SWELLING PACKER ELEMENT WITH ENHANCED SEALING FORCE

(75) Inventor: Robert S. O'Brien, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 187 days.

(21) Appl. No.: 11/493,286

(22) Filed: Jul. 26, 2006

(65) Prior Publication Data

US 2008/0023193 A1 Jan. 31, 2008

(51) Int. Cl.
*E21B 33/12* (2006.01)

(52) U.S. Cl. ..... 166/179

(58) Field of Classification Search ..... 166/387, 166/179, 138
See application file for complete search history.

(56) References Cited

U.S. PATENT DOCUMENTS

| | | | | |
|---|---|---|---|---|
| 2,241,532 | A | 5/1941 | Barnes | |
| 3,693,408 | A * | 9/1972 | Hyde | 73/49.8 |
| 4,141,413 | A * | 2/1979 | Morris et al. | 166/120 |
| 4,515,213 | A | 5/1985 | Rogen et al. | |
| 5,176,217 | A * | 1/1993 | Luke et al. | 166/195 |
| 5,851,013 | A | 12/1998 | Simons | |
| 5,941,313 | A | 8/1999 | Arizmendi | |
| 6,666,276 | B1 * | 12/2003 | Yokley et al. | 166/387 |
| 6,827,150 | B2 | 12/2004 | Luke | |
| 6,834,725 | B2 | 12/2004 | Whanger et al. | |
| 6,923,263 | B2 | 8/2005 | Eden et al. | |
| 2004/0194971 | A1 | 10/2004 | Thomson | |
| 2005/0072579 | A1 | 4/2005 | Gambier | |
| 2005/0155775 | A1 * | 7/2005 | Hirth et al. | 166/387 |
| 2005/0230100 | A1 * | 10/2005 | Hirth et al. | 166/120 |
| 2005/0241833 | A1 | 11/2005 | Bailey et al. | |
| 2007/0144733 | A1 | 6/2007 | Murray et al. | |
| 2007/0163777 | A1 * | 7/2007 | Murray et al. | 166/179 |

FOREIGN PATENT DOCUMENTS

| | | |
|---|---|---|
| GB | 21976/33 | 2/1934 |
| GB | 2373799 A | 10/2002 |
| GB | 2403744 A | 1/2005 |
| GB | 2417272 | 2/2006 |
| WO | 2006098631 A1 | 9/2006 |

* cited by examiner

*Primary Examiner*—William P Neuder
(74) *Attorney, Agent, or Firm*—Steve Rosenblatt

(57) ABSTRACT

A packer that uses an element that swells to the set position is disclosed having a device that boosts the set force of the swollen element against the borehole. The force is axially applied at one end or two and preferably comprises a cone driven by a stored or applied force such that the cone is driven between the element and the mandrel that supports the element. Initiation of the boost force can be varied in its timing and the power behind the cone can come from a variety of sources such as a spring, hydrostatic pressure, or applied forces, to name a few. The movement of the cone is locked to prevent reversal of its motion when the packer is set. The swelling enhances the engagement of the element to the cone to minimize relative movement between them.

20 Claims, 1 Drawing Sheet

SWELLING PACKER ELEMENT WITH ENHANCED SEALING FORCE

FIELD OF THE INVENTION

The field of the invention is packers for downhole use that employ a sealing element that swells where the setting force is enhanced beyond the swelling with an applied force preferably axially in at least one direction.

BACKGROUND OF THE INVENTION

Packers for downhole use come in a variety of constructions. Some involve high ratios of expansion as between the set and the run in positions. These designs usually involve a collapsing petal shaped backup ring so as to control extrusion when the element is compressed axially over a stroke that is substantially longer than more conventional compression set packers. An example of such a design is U.S. Pat. No. 6,827,150. Other packer designs also address the extrusion issue as a result of setting the packer in a variety of ways, as shown for example in U.S. Pat. No. 5,941,313. Some packers use an element that can swell and expand a mandrel that lies beneath it, as illustrated in U.S. Pat. No. 6,834,725 and published application US 2004/0194971 A1.

One issue that arises with sealing elements that swell is that they get softer upon swelling and do not grip as firmly. Upon a change in well conditions such as temperature fluctuations or differential pressure variations, such set packers can lose their grip. In designs that do not involve mandrel expansion under a swelling element this is a concern for operators. Mandrel expansion increases the radial force on the swollen element but still leaves the issue of the swollen material being softer after swelling, which presents a risk of leakage or loss of grip. Swelling element packers are desirable in that they can be run in the well quickly and can assume a set position after leaving time to run them into position. Interaction with well fluids initiates the swelling to the point where sealing contact is obtained. It is advantageous to boost the sealing force of a swelling element in some way to better insure sealing integrity under a variety of conditions.

One approach to dealing with the sealing integrity concern can be seen in US 2005/0072579 in the context of a compression set packer. The variations disclosed in this reference deal with creation of potential energy in an element that is covered by the sealing element initially and which takes on a potential energy force when the sealing element that surrounds it is axially compressed. In one design the potential energy storing element is a swelling material disposed within the sealing element. These designs apply a very limited boost force by virtue of the positioning wholly under the sealing element and further dependence on movement of mandrel components that compress the element to additionally provide a potential energy force. The boosting device in this design is akin to a beam supported at opposed ends where the ends are pushed together to bend it. The middle of such a device can collapse due to lack of support if overloaded during setting or from the element due to changed conditions downhole.

Other references in the area of seals used in downhole applications are U.S. Pat. Nos. 6,923,263 and 5,851,013 as well as US Application 2005/0241833 and GB Applications 2,403,744 and 2,373,799.

The present invention addresses the need to boost the set of a swelling element in a variety of solutions. Preferably a cone shaped sleeve is driven axially in at least one direction adjacent at least one end of the swelling element so that preferably it can travel between the mandrel and the element and preferably have its motion locked in against reverse movement. These and other advantages of the present invention will be more apparent to those skilled in the art from a review of the description of the preferred embodiment and the associated drawings while the claims appended below denote the full scope of the invention.

SUMMARY OF THE INVENTION

A packer that uses an element that swells to the set position is disclosed having a device that boosts the set force of the swollen element against the borehole. The force is axially applied at one end or two and preferably comprises a cone driven by a stored or applied force such that the cone is driven between the element and the mandrel that supports the element. Initiation of the boost force can be varied in its timing and the power behind the cone can come from a variety of sources such as a spring, hydrostatic pressure, or applied forces, to name a few. The movement of the cone is locked to prevent reversal of its motion when the packer is set. The swelling enhances the engagement of the element to the cone to minimize relative movement between them.

DETAILED DESCRIPTION OF THE PREFERRED EMBODIMENT

Figure 1:
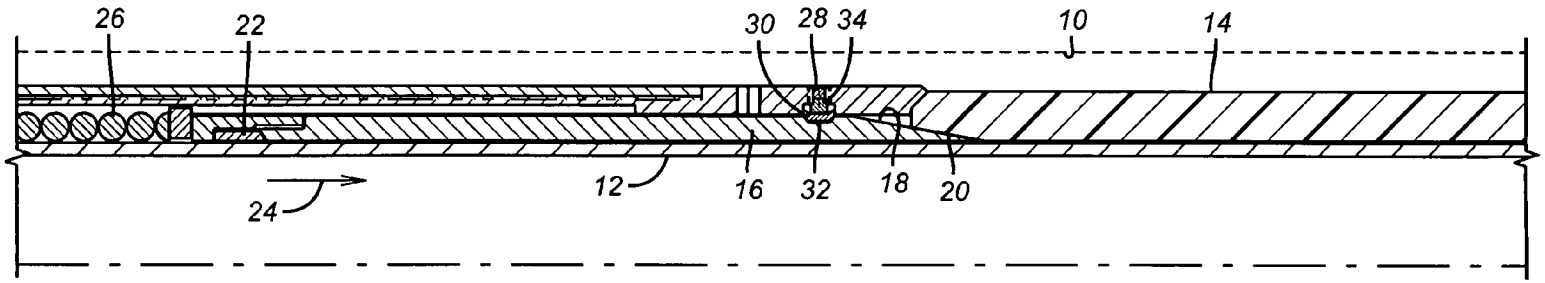
FIG. 1 shows the run in condition for a packer with a swelling element.
Figure 2:
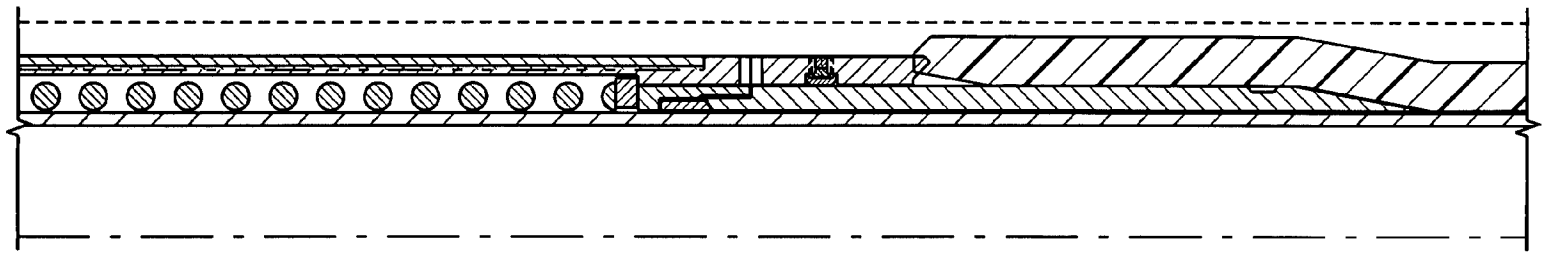
FIG. 2 shows the onset of the boost force being applied to the element.
Figure 3:
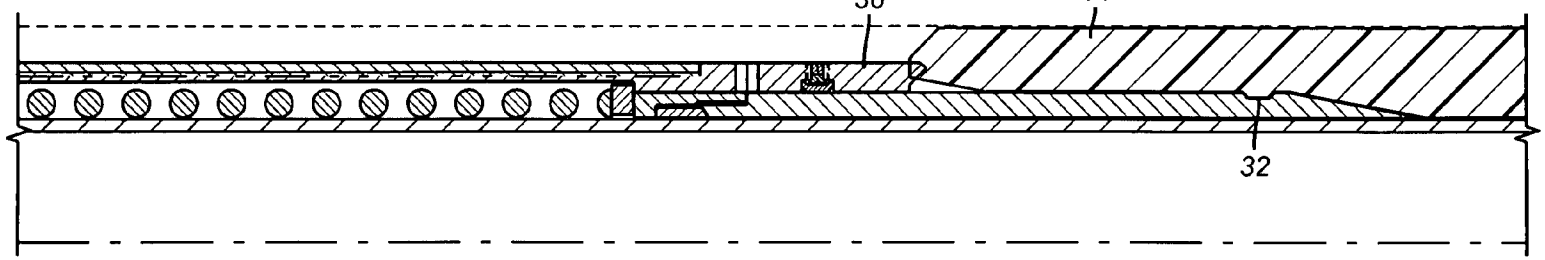
FIG. 3 shows the element fully swollen and engaged to the cone.

FIG. 1 shows an open hole 10 with a mandrel 12 positioned in the desired location. A sealing element 14 is mounted to the mandrel 12 and is preferably made of a material that swells in the fluids found in the wellbore or added to it as opposed to being compressed along a mandrel to gain an initial seal. For example, the element 14 can be made of rubber. A cone 16 has a leading taper 18 and the element 14 has a complementary taper 20. The cone carries a ratchet lock 22 that allows the cone 16 to move in the direction of arrow 24 but to have its movement in a reverse direction prevented. One way a potential energy force can be stored against the cone 16 is to use a precompressed spring 26. The run in position in FIG. 1 for the cone 16 can be retained against the force of the spring 26 with a release device 28, which can be a shear pin, for example. In FIG. 1 the release device comprises a lock ring 30 in a groove 32 on the cone 16. A release 34 allows the ring 30 to spring out of groove 32 at the desired time to allow the stored force of spring 26 to drive cone 16 under the element 14. The triggering event for release of the cone 16 for movement can be varied. The release 34 can be actuated chemically, electrically, acoustically, mechanically or other ways that will get the cone 16 moving. The timing of the release can be before, during swelling or after the element 14 has finished swelling. FIG. 2, for example shows movement of the cone 16 under the element 14 before the element 14 has had much if any swelling. FIG. 3 shows the element 14 fully swollen. It should be noted that element 14 has swollen into groove 32 formerly occupied by ring 30 for run in. This helps reduce the tendency of relative movement between the element 14 and the cone 16, which is now locked in position by ratchet lock 22.

It should be noted that the element 14 can have a boost applied at opposite ends in opposed directions with boost devices that are either identical or different. Rather than using a cone with a taper 18 the final component that contacts the element 14 can abut it rather than go under it along the mandrel 12. Alternatively, the contact can be a combination of abutting the element 14 on end and sliding under it, as shown in the Figures. The cone 16 can also include an end ring 36 shown schematically in FIG. 3 to act as an extrusion barrier to the swollen element 14 after it is placed in service. Triggers for the boost may include atmospheric chambers, explosive charges or hydrostatic pressure as a few examples. The boost technique can be applied to cups at ends of a sealing element. The boost can be a compressing force independent of a compressive force applied to the sealing element in the case of a compression set packer. With a swelling element, the boost can be independent of the trigger that starts the swelling or the same trigger can be used to initiate the swelling and release the boost device. Those events can either be initiated at the same time or be delayed depending on the application.

The above description is illustrative of the preferred embodiment and many modifications may be made by those skilled in the art without departing from the invention whose scope is to be determined from the literal and equivalent scope of the claims below.

I claim:

1. A packer for sealing a wellbore, comprising:
a mandrel having a passage and a longitudinal axis;
a sealing element mounted to said mandrel and capable of swelling to seal off the wellbore without radial expansion of said passage;
at least one boost device mounted on said mandrel and outside said passage and selectively movable in a first direction to apply a boost force to said sealing element and mechanically locked to prevent movement in an opposite direction to said first direction to retain said boost force on the seal created by said swelling of said sealing element.

2. The packer of claim 1, wherein:
said boost device moves along said mandrel.

3. The packer of claim 2, wherein:
said boost device abuts an end of said element.

4. The packer of claim 1, wherein:
said boost device further comprises an extrusion barrier that contacts an end of said element.

5. The packer of claim 1, wherein:
said boost device comprises opposing boost devices at opposed ends of said element that are movable toward each other.

6. The packer of claim 5, wherein:
said boost devices are identical.

7. A packer for sealing a wellbore, comprising:
a mandrel having a passage and a longitudinal axis;
a sealing element mounted to said mandrel and capable of swelling to seal off the wellbore without radial expansion of said passage;
at least one boost device mounted on said mandrel and outside said passage and movable in a direction of said longitudinal axis to enhance the sealing created by said swelling of said sealing element;
said boost device moves between said element and said mandrel.

8. The packer of claim 7, wherein:
said boost device comprises a cone.

9. The packer of claim 8, wherein:
said boost device is movable in a single direction toward said element.

10. The packer of claim 8, wherein:
said boost device is selectively retained by a lock.

11. The packer of claim 10, wherein:
said lock is unlocked by exposure to well fluid that makes said element swell.

12. The packer of claim 10, wherein:
said lock is unlocked independently of exposure to fluids that start said element swelling.

13. The packer of claim 10, wherein:
said boost device stores a force that is released by said lock.

14. The packer of claim 13, wherein:
said force stored by said boost device is created independently of swelling by said element.

15. The packer of claim 7, wherein:
said element swells into engagement with said boost device that impedes relative movement of said element in the direction of said longitudinal axis.

16. A packer for sealing a wellbore, comprising:
a mandrel having a passage and a longitudinal axis;
a sealing element mounted to said mandrel and capable of swelling to seal off the wellbore without radial expansion of said passage;
at least one boost device mounted on said mandrel and outside said passage and movable in a direction of said longitudinal axis to enhance the sealing created by said swelling of said sealing element;
said boost device comprises opposing boost devices at opposed ends of said element that are movable toward each other;
said boost devices are identical and movable only in one direction to get closer to each other;
said boost devices each comprise a cone that is movable along said mandrel and under said element.

17. The packer of claim 16, wherein:
said boost devices store a force that is selectively released before, during or after conclusion of swelling by said element.

18. The packer of claim 17, wherein:
said stored force comprises at least one of a spring, an atmospheric chamber, an explosive charge and a piston.

19. The packer of claim 17, wherein:
said force is stored by a selectively releasable lock that operates independently of the trigger for swelling in said element.

20. A packer for sealing a wellbore, comprising:
a mandrel having a passage and a longitudinal axis;
a sealing element mounted to said mandrel and capable of swelling to seal off the wellbore without radial expansion of said passage;
at least one boost device mounted on said mandrel and outside said passage and movable in a direction of said longitudinal axis to enhance the sealing created by said swelling of said sealing element;
said boost device comprises opposing boost devices at opposed ends of said element that are movable toward each other;
said boost devices further comprise an extrusion barrier.

* * * * *